United States Patent [19]

Schärer

[11] 4,361,330

[45] Nov. 30, 1982

[54] TARGET WITH INTERCHANGEABLE TARGET IMAGES

[75] Inventor: Ferdinand Schärer, Muri, Switzerland

[73] Assignee: Polytronic AG, Muri, Switzerland

[21] Appl. No.: 227,769

[22] Filed: Jan. 23, 1981

[30] Foreign Application Priority Data

Jan. 24, 1980 [CH] Switzerland ..... 565/80

[51] Int. Cl.[3] ..... F41J 9/24; F41J 7/00

[52] U.S. Cl. ..... 273/372; 273/406

[58] Field of Search ..... 273/371, 372, 388, 406

[56] References Cited

U.S. PATENT DOCUMENTS

| | | | |
|---|---|---|---|
| 2,294,730 | 9/1942 | Eggers | 273/371 X |
| 3,778,059 | 12/1973 | Rohrbaugh et al. | 273/372 |
| 3,914,879 | 10/1975 | Taylor et al. | 273/406 X |
| 4,283,060 | 8/1981 | Braunschweiler | 273/388 X |

*Primary Examiner*—Anton O. Oechsle

*Attorney, Agent, or Firm*—Karl F. Ross

[57] ABSTRACT

A target for a rifle range has an upright with a rectangular opening adapted to be alternately occupied by two sheets carrying different target images. The sheets may be mounted back-to-back on a common support, such as a swingable frame, or may be interconnected to form an endless band led around rollers. The mounting frame can be internally equipped with electroacoustic or other sensors to serve as an impact-detecting chamber.

4 Claims, 5 Drawing Figures

TARGET WITH INTERCHANGEABLE TARGET IMAGES

FIELD OF THE INVENTION

My present invention relates to a target to be used in a rifle range or the like for firearm practice.

BACKGROUND OF THE INVENTION

Such practice frequently calls for the use of at least two separate target images of different configurations. To facilitate the change from one target image to another it is known to provide separate image-carrying plates guided in respective tracks one behind the other for selective emplacement in the firing line. This mechanism is relatively complex and also modifies, albeit only slightly, the distance of the target image from the marksman. When the target is to be equipped with conventional electronic devices for registering the point of impact, such a change in position is inadmissible so that a manual replacement of the target carrier becomes necessary, requiring an interruption of the firing operation.

OBJECT OF THE INVENTION

The object of my present invention, therefore, is to provide an improved target with plural images in which these drawbacks are obviated.

SUMMARY OF THE INVENTION

I realize this object, pursuant to my present invention, by the provision of a support displaceable on an upright, this support having a plurality of surface areas carrying different target images which are respectively displayed in a predetermined vertical plane upon movement of the support into a plurality of working positions thereof.

The support may comprise a flat member, preferably a frame, which is pivotally mounted on the upright for a 180° swing to display either of two target images carried on opposite surfaces thereof. Such a frame, spanned on opposite sides by image-carrying sheets, may be designed as an impact-detecting chamber with electroacoustic or other sensing means as is well known per se. On the other hand, the support may comprise a flexible sheet of several target images on adjoining areas of the same surface, the sheet being partly wound on roller means for movement into any working position. Advantageously, the sheet is in the form of an endless band embracing two rollers.

BRIEF DESCRIPTION OF THE DRAWING

The above and other features of my invention will now be described in detail with reference to the accompanying drawing in which.

SPECIFIC DESCRIPTION

Figure 1A:
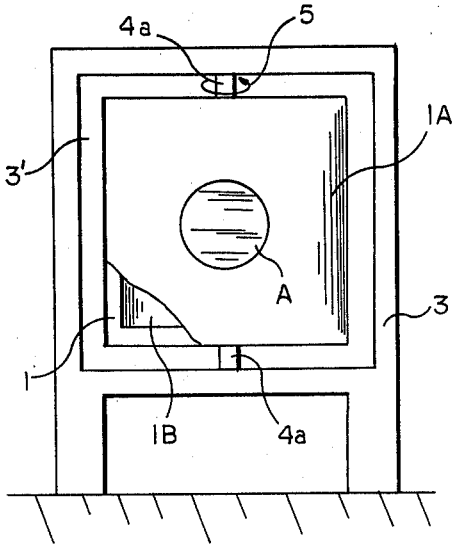
FIG. 1A is a front-elevational view of a target embodying my invention.

In FIG. 1A I have shown a target comprising an upright 3 with a rectangular (here approximately square) opening 3' in which a supporting member 1 in the form of a frame is pivotally mounted for swinging about a vertical axis defined by two axles 4*a*, as indicated by an arrow 5. One side of frame member 1 is spanned by a sheet 1A on which a circular target image A is centered; the opposite side of the frame, spanned by a sheet 1B, carries a differently shaped target image B which is not visible in FIG. 1A but has been illustrated in FIG. 1B. The latter shows a target differing from that of FIG. 1A merely by the fact that the supporting frame 1 is here swingable about a horizontal axis defined by two axles 4*b* as indicated by an arrow 6. In both instances, the changeover from one woring position—displaying the target image A—to the other working position—displaying the target image B—and vice versa involves merely a 180° swing of the supporting frame about its pivotal axis; this may be accomplished manually, as by a nonillustrated crank, or with the aid of a drive motor as described hereinafter with reference to FIG. 4. Moreover, the two working positions of the supporting frame can be defined by a suitable abutment projecting into the opening 3', again as described below with reference to FIG. 4.

Figure 1B:
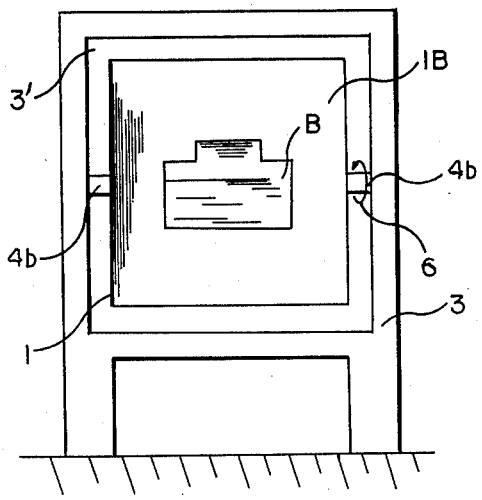
FIG. 1B is a view similar to that of FIG. 1A, showing a slightly modified target in an alternate working position.
Figure 2:
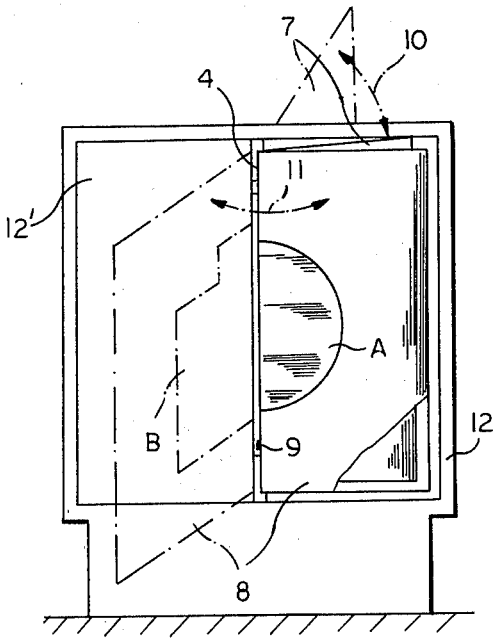
FIG. 2 is a front-elevational view of yet another modification of the target shown in FIG. 1A.

FIG. 2 shows a target with an upright 12 whose square opening 12' accommodates an image support generally similar to the frame 1 of FIGS. 1A and 1B but divided into two halves 7 and 8 which are separately hinged at 9 to a common vertical shaft 4 and carry complementary portions of target images A and B. In a nonworking position, illustrated in solid lines, the two halves 7 and 8 are folded together; they can, however, be swung apart as indicated by arrows 10, 11 and illustrated in phantom lines. Members 7, 8 may be indexed by suitable detents, not shown, in either of two coplanar working positions to display image A or B in the opening 12'.

Naturally, the foldable image support 7, 8 could also be made swingable about a horizontal rather than a vertical axis in the manner illustrated in FIG. 1B.

Figure 3:
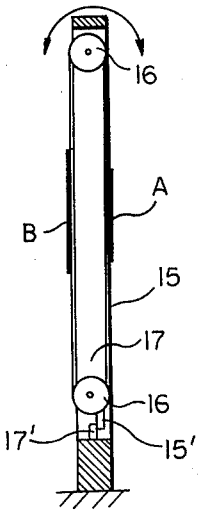
FIG. 3 is a side-elevational view of a different embodiment.

In FIG. 3 I have shown an upright 17 in whose opening a support 15 in the form of an endless band is wound about two deflecting rollers 16, the outer surface of this band carrying the two target images A and B. Upon manual or automatic rotation of these rollers, the band 15 may be displaced so as to exhibit either of these images to a marksman positioned to one side thereof, e.g. at its right as seen in FIG. 3. A stud 15' on band 15 may coact with a stop 17' on upright 17 to arrest that band in either of its two working positions.

Figure 4:
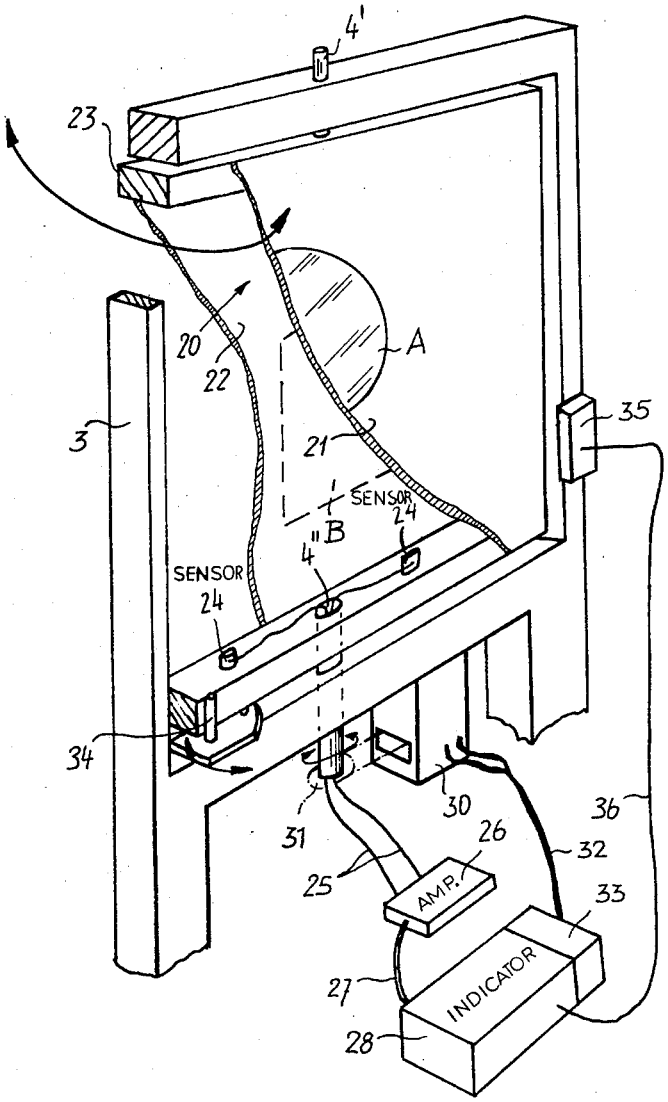
FIG. 4 is a perspective view (parts broken away) of a further embodiment.

Reference is now being made to FIG. 4 which shows an upright 2 similar to that of FIGS. 1A and 1B together with an image support comprising a frame 23 and two sheets 21, 22 spanning its sides, these sheets again carrying respective target images A and B. Frame 23 is journaled in the opening of upright 3 for rotation about a vertical axis by means of a solid upper gudgeon 4' and a tubular lower trunnion 4'', the latter accommodating signal wires 25 which extend from a pair of electroacoustic sensors 24 mounted on the lower frame element. Sensors 24, which conventionally detect the point of impact of a shot on one of the sheets 21, 22, are connected by wires 25 to an amplifier 26 from which a cable 27 leads to an evaluator 28 visually indicating the occurrence of a hit. Thus, the support consisting of sheets 21, 22 and frame 23 defines an impact-detecting chamber 20 effective in either working position thereof; these working positions are established by the engagement of the support with a stud 34 projecting into the opening of upright 3.

Trunnion 4″ is linked by a chain 31 to a reversible drive motor inside a casing 30 connected via a cable 32 to a power supply 33 which may include a timer for periodically changing the position of the image support. Alternatively, the drive motor may be manually switchable to move the support into one or the other working position. A monitoring switch 35, which could be of the contactless proximity type, deactivates the evaluator 28 via a signal line 36 whenever the support 21–23 is not in a working position.

I claim:

1. A target for firearm practice, comprising:

an upright;

a frame on said upright with opposite vertical sides spanned by a pair of sheets carrying different target images, said frame being pivotally supported on said upright for rotation into either of two diametrically opposite working positions respectively displaying said target images to a marksman standing on a given side of said upright;

electroacoustic sensing means in said frame for ascertaining the point of impact of a shot striking either of said sheets;

indicator means connected to said sensing means; and switch means on said upright connected to said indicator means and operable by said frame in either of said working positions for activating said indicator means to register the occurrence of a hit but deactivating same in any other frame position.

2. A target as defined in claim 1, further comprising abutment means on said upright for arresting said frame in either of its working positions.

3. A target as defined in claim 1 or 2, further comprising motor means coupled with said frame for moving same into either of said working positions.

4. A target as defined in claim 3 wherein said frame is mounted on said upright by a vertical shaft coupled with said motor means.

* * * * *